United States Patent [19]

Stark, Sr.

[11] Patent Number: 5,014,370

[45] Date of Patent: May 14, 1991

[54] SWIMMING POOL BULKHEAD

[76] Inventor: Robert Stark, Sr., 735 NE. 198th, Seattle, Wash. 98155

[21] Appl. No.: 343,434

[22] Filed: Apr. 26, 1989

[51] Int. Cl.[5] ..... E04H 3/18

[52] U.S. Cl. ..... 4/505; 4/496; 4/497

[58] Field of Search ..... 4/487, 488, 497, 505, 4/506, 495, 496, 494; 52/64, 726, 169.7, 243.1; 272/3, 4, 66, 71, 105; 114/362, 364, 85, 88, 264; 405/218, 219, 220, 221; 441/39

[56] References Cited

U.S. PATENT DOCUMENTS

| | | | |
|---|---|---|---|
| 3,582,999 | 6/1971 | Baker | 4/497 |
| 3,842,484 | 10/1974 | Stark | 4/497 |
| 3,935,599 | 2/1976 | Stark | 4/505 |
| 3,962,735 | 6/1976 | Davidson | 4/505 |
| 4,292,696 | 6/1981 | Berger | 4/496 |
| 4,567,845 | 2/1986 | Smith | 114/364 |
| 4,574,404 | 3/1986 | Stark | 4/505 |
| 4,589,366 | 5/1986 | Eiber | 114/364 |
| 4,630,561 | 12/1986 | Franz et al. | 114/85 |

FOREIGN PATENT DOCUMENTS

| | | | |
|---|---|---|---|
| 1087671 | 10/1967 | United Kingdom | 4/505 |

*Primary Examiner*—Henry J. Recla
*Assistant Examiner*—Glenn T. Barrett
*Attorney, Agent, or Firm*—Seed and Berry

[57] ABSTRACT

A bulkhead is illustrated with sockets through the top deck and an intermediate platform to provide a box-frame structural strength to the bulkhead and to receive pool attachments for swimming activities, such as diving platforms or water polo goals. Another invention is the provision of tongue members for joining separate sections of a bulkhead which is assembled together at the swimming pool site. These tongue members can be longitudinal tongue members protruding from one or the other of the sections or they can be transverse tongue members which are on each section and are secured together. There is also an invention of access ports through both the top deck and the intermediate platform of a hollow swimming pool bulkhead for providing access to the interior of the bulkhead.

3 Claims, 2 Drawing Sheets

FIG. 1
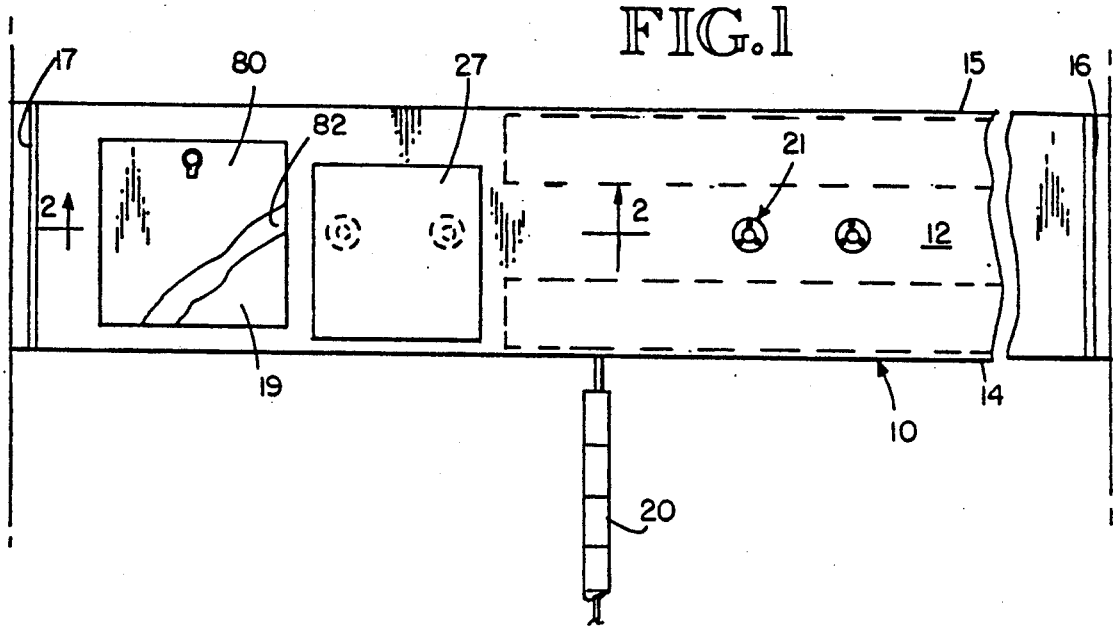
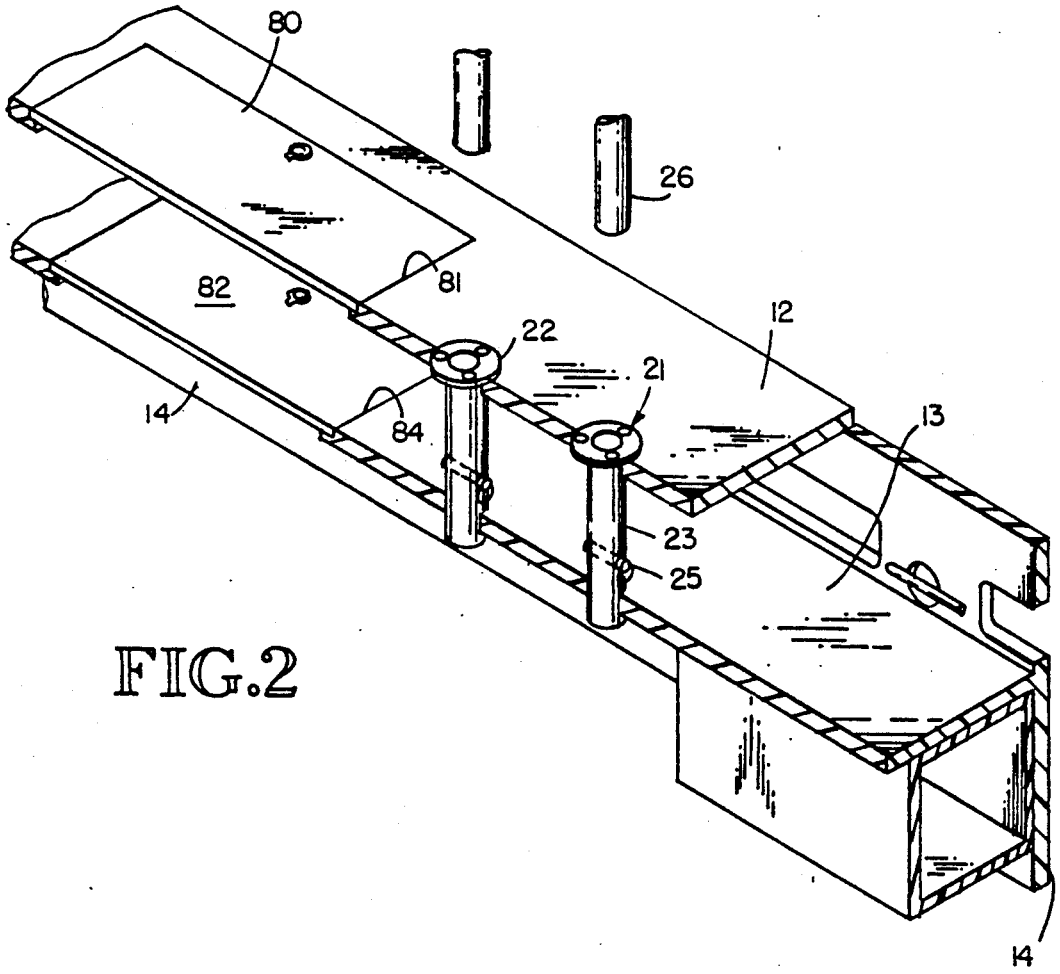
FIG. 2

FIG. 3
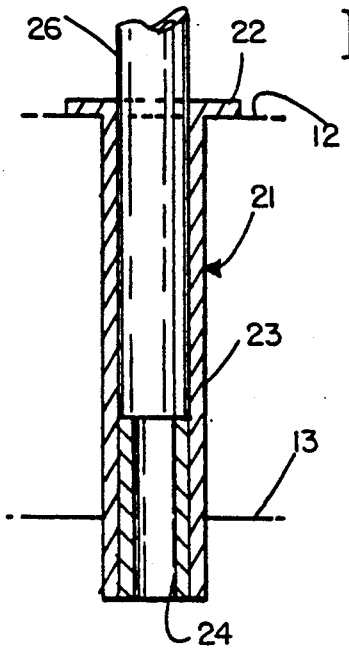
FIG. 4
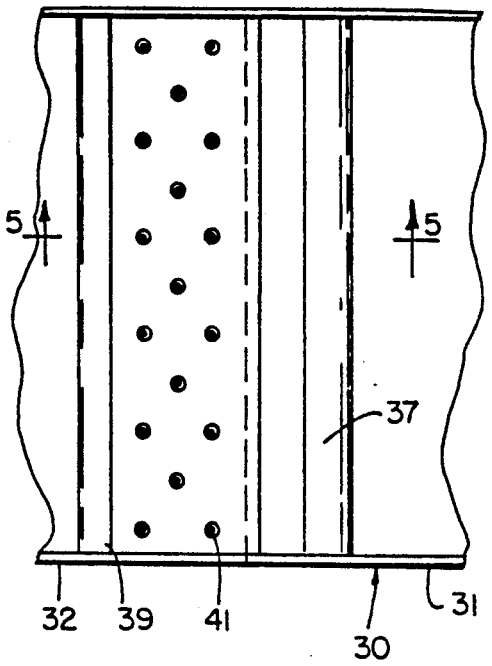
FIG. 6
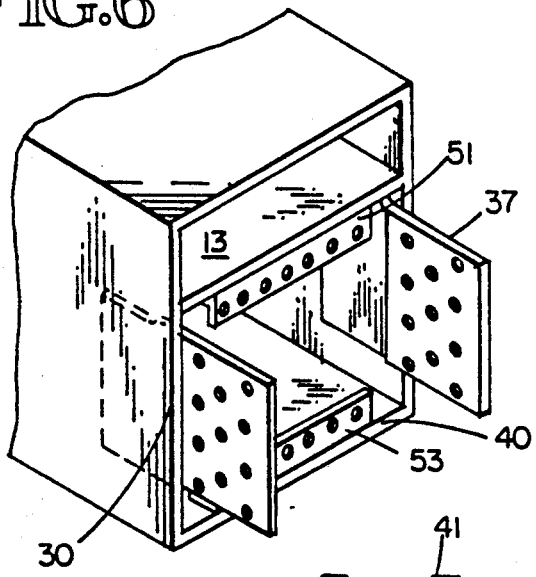
FIG. 5
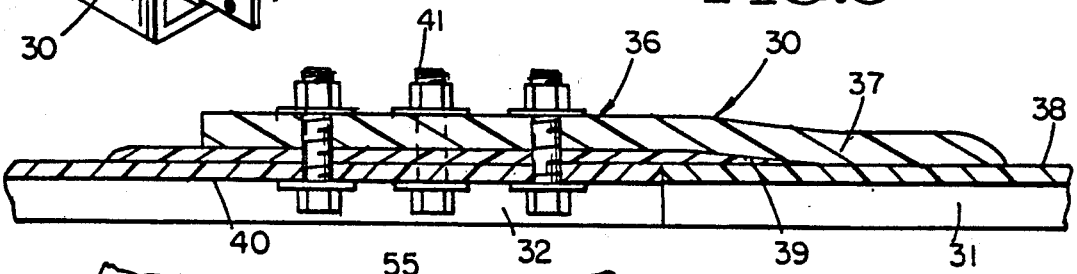
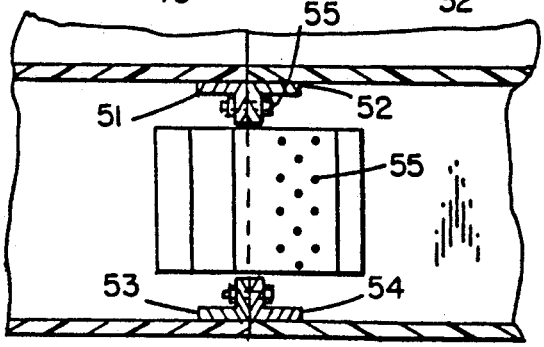
FIG. 7

SWIMMING POOL BULKHEAD

DESCRIPTION

1. Field of the Invention

This invention pertains to swimming pool bulkheads of the type used to divide a swimming pool for restricting the length of the pool. Frequently, these types of bulkheads are also used as diving platforms or supports for equipment for other swimming pool activities. This invention pertains to improvements in a construction of such bulkheads for increasing the bulkhead strength, providing adaptability for use of swimming pool equipment, and providing better access to the bulkhead for improving maintenance.

2. Background Art

Swimming pool bulkheads are known. U.S. Pat. Nos. 3,842,484; 4,574,404; 3,935,599; and pending application Ser. No. 07/25,1903, filed Sept. 30, 1988, all disclose examples of bulkheads for use in swimming pools.

The bulkheads of the above patents are considered unique in the industry. The bulkheads in the above patents have a top deck on which the swimmers stand or equipment for the swimming pool activities are mounted and an intermediate platform providing openings for reducing wave reflection. The bulkheads generally include hollow compartments that open to the water. In one bulkhead, some compartments can be inflated with air to provide buoyancy to the bulkhead. The bulkheads can be shipped to the pool site in sections and assembled together at the pool site or a bulkhead can be shipped as a single integral unit.

While these various bulkheads have proven quite satisfactory in terms of manufacture, shipment and use, there is a need for providing increased usability and strength to the bulkheads, particularly when the bulkheads are used for activities that place high stresses on the structure of the bulkhead.

SUMMARY OF THE INVENTION

One invention is the provision of hollow vertical sockets through the top deck of the bulkhead for attaching posts of diving platforms, water polo goals, or other structures. The sockets advantageously extend through the top deck and down through the intermediate platform of the bulkhead, providing a unique high-strength, box-frame construction. This box-frame construction adds stability to the equipment placed in the sockets. The box-frame construction also adds strength and stability to the length of the bulkhead such that the pulling tensile forces caused by lane-line ropes attached to the front wall of the bulkhead are resisted to reduce bowing of the bulkhead from the stress supplied by these lane-line ropes.

The second invention is a technique for butt-joining sections of a bulkhead, which makes the bulkhead sections easy to manufacture and easy to assemble at the pool site. In one embodiment of this invention, tongue members protrude longitudinally from one section and are bolted to the opposite section. In another embodiment, tongue members protrude transversely from one section and are bolted to adjoining transverse tongue members on the other section. In a final embodiment, both the transverse tongue members and the longitudinal tongue members can preferably be used to provide the highest strength connection between the two sections.

Still another invention is the provision of access doors through both the top deck and the intermediate platform to provide personnel access into . the hollow compartments of the bulkhead for doing internal maintenance on the bulkhead.

BRIEF DESCRIPTION OF THE DRAWINGS

FIG. 1 is a fragmentary plan view of a bulkhead embodying the principles of the invention.

FIG. 2 is a fragmentary isometric section looking along the line 2—2 of FIG. 1.

FIG. 3 is a fragmentary section through one of the socket members embodying the invention.

FIG. 4 is a bottom fragmentary plan of two sections of a bulkhead joined together.

FIG. 5 is a section taken along the line 5—5 of FIG. 4.

FIG. 6 is a fragmentary isometric showing another embodiment of the invention.

FIG. 7 is a fragmentary vertical section showing the embodiment of FIG. 6.

DETAILED DESCRIPTION OF THE PREFERRED EMBODIMENTS

As best shown in FIGS. 1, 2 and 3, a bulkhead 10 has a top deck 12, an intermediate platform 13 spaced below the top deck, a front wall 14 joined to the intermediate platform and the top deck, a rear wall 15 opposite end walls 16 and 17, and a bottom 19.

Lane-line ropes 20 are fastened to the forward wall. These lane-line ropes on a very long bulkhead can produce pulling stresses tending to bow the bulkhead.

Secured to the top of the top deck and flush with the top deck are socket members 21 bolted or screwed through flanges 22. The socket members are preferably in the form of an elongated stainless steel tube 23 which extends downwardly through the intermediate platform 13. The sockets advantageously are secured to the top deck and extend down Well beloW the intermediate platform for the purpose of providing a box frame formed from the top deck 12, intermediate platform 13, front wall 14, and the socket members. Thus, any pull by the lane-line ropes on the front wall is additionally withstood by the box frame formed with the socket members. The socket members are distributed in sets of two, uniformly spaced throughout the length of the bulkhead. The sets of sockets are positioned exactly centrally between the lane-line ropes.

The sockets are provided with stops in the form of either an internal tube 24 (FIG. 3) welded to the tube 23 or a pin 25 (FIG. 2). The stops seat the posts 26 of a diving platform, goal net for water polo, etc.

Since the sockets also extend through the intermediate platform, they provide strength and stability from the forces of divers pushing off from the diving platform and provide a stable attachment for these diving platforms.

As best shown in FIGS. 4–7, various techniques for joining sections of swimming pool bulkheads are shown. As best shown in FIG. 4, a bulkhead 30 is comprised of a section 31 and a section 32, with the ends of the sections butted together to form the bulkhead. It is important that these bulkhead sections be easily assembled and connected together to provide a high-strength, stable connection to withstand the various forces acting on the bulkhead when the bulkhead is being used in swimming activities. The pull from the lane-line ropes, the wave action from swimmers, and the thrust from diving swimmers all put tremendous stresses on the bulkhead.

As best shown in FIGS. 4 and 5, one technique for joining the sections includes a tongue member 36 formed from a thick layer of fiberglass 37 joined and glassed to the bottom wall 38 of section 31 of the bulkhead, and an additional second layer 39 also glassed to the bottom wall 38 of section 31. This tongue member then protrudes longitudinally of the bulkhead and overlies the bottom wall 40 of the second section 32. Bolts 41 connect the tongue member to the bottom wall of the second section.

This tongue member can be provided on a bottom wall, on the opposite top wall, on the intermediate platform and bottom wall, on opposite side walls, or on all four of the walls.

As best shown in FIGS. 6 and 7, another form of tongue member 51 is illustrated. In this form of the invention, L-shaped, transverse tongue members are glassed to each section bottom wall or side walls, or intermediate platform. An adjacent transverse tongue member 52 is then glassed to the corresponding wall of the other section. Bolts 55 then bolt the adjoining transverse tongues together.

As shown in FIGS. 6 and 7, any combination of longitudinal tongue members 30 or transverse tongue members can be provided. In FIG. 6, as illustrative of one embodiment, the transverse tongue members protrude from the intermediate platform 13 and the bottom wall 40, with the longitudinal tongue members protruding from two opposite side walls. Obviously, the longitudinal tongue members could be on the intermediate platform and bottom wall and the transverse tongue members on the side walls, or any combination as desired.

These tongue members provide high-strength and quick-connecting provisions for joining the sections of a bulkhead together.

As best shown in FIGS. 1 and 2, another invention is an access door 80 covering an access opening through the top deck 12, and a second access door 82 which covers an opening 84. These access openings allow entry into the hollow compartments within the bulkhead. Preferably, the pool will be drained and personnel can enter the bulkheads through the doors 80 and 82 without having to remove the bulkhead from the pool for internal maintenance.

While various inventions and embodiments of these inventions have been illustrated and described, it should be apparent that variations will be apparent to those skilled in the art. Accordingly, the invention is not limited to the specific embodiments illustrated in the drawing.

I claim:

1. A swimming pool bulkhead adapted to be positioned in a swimming pool and used to support swimming equipment for swimming activities in the pool, comprising:

an elongated, submersible hollow body having a top deck, front and rear side walls, end walls and a bottom;

an intermediate platform spaced below the top deck; and elongated, vertical hollow sockets fixed to the top deck and extending through the intermediate platform forming a box frame with the top deck, front wall, intermediate platform and the sockets, and adapted for receiving a diving platform or other swimming equipment, said sockets being flush with the top deck and having inserts therein for locating the diving platform therein.

2. The bulkhead of claim 1, said sockets being hollow tubes.

3. The swimming pool bulkhead of claim 1, wherein the top deck and intermediate platform contain an access door to permit personnel to enter an interior compartment formed by the side and end walls, the bottom, and the intermediate platform for internal inspection of the bulkhead.

* * * * *